US008029303B2

(12) United States Patent
Chiang

(10) Patent No.: US 8,029,303 B2
(45) Date of Patent: Oct. 4, 2011

(54) MULTI-IN-ONE-CONNECTOR

(75) Inventor: Jui-Tu Chiang, Jhonghe (TW)

(73) Assignee: Taiwin Electronics Co., Ltd (TW)

( * ) Notice: Subject to any disclaimer, the term of this patent is extended or adjusted under 35 U.S.C. 154(b) by 16 days.

(21) Appl. No.: 12/542,608

(22) Filed: Aug. 17, 2009

(65) Prior Publication Data

US 2010/0233912 A1 Sep. 16, 2010

(30) Foreign Application Priority Data

Mar. 12, 2009 (TW) ..... 98107996 A
Apr. 14, 2009 (TW) ..... 98206069 U

(51) Int. Cl.
*H01R 29/00* (2006.01)

(52) U.S. Cl. ..... 439/172; 439/131; 439/518

(58) Field of Classification Search ..... 439/172–175, 439/518, 131
See application file for complete search history.

(56) References Cited

U.S. PATENT DOCUMENTS

| | | | | |
|---|---|---|---|---|
| 3,025,486 | A * | 3/1962 | Falconer | 439/103 |
| 6,808,400 | B2 * | 10/2004 | Tu | 439/131 |
| 6,923,666 | B1 * | 8/2005 | Liao | 439/172 |
| 7,121,850 | B2 * | 10/2006 | Yeh | 439/131 |
| 7,537,471 | B2 * | 5/2009 | Teicher | 439/172 |
| 7,787,243 | B2 * | 8/2010 | Salazar et al. | 361/679.31 |

* cited by examiner

*Primary Examiner* — Truc Nguyen
(74) *Attorney, Agent, or Firm* — Hershkovitz & Associates, LLC; Abraham Hershkovitz

(57) ABSTRACT

A multi-in-one connector has a casing and a plug assembly. The casing has a cavity and a front opening communicating with the cavity. The plug assembly is mounted in the cavity and extends through the front opening and has a first plug and a second plug. The second plug is separately stacked with the first plug and mounted slidably in the cavity through the front opening, wherein the second plug moves relative to the first plug to extend out of or retract from the front opening. Hence the multi-in-one connector is compatible with at least two connection interfaces of connector sockets.

17 Claims, 28 Drawing Sheets

MULTI-IN-ONE-CONNECTOR

BACKGROUND OF THE INVENTION

1. Field of the Invention

The present invention relates to a multi-in-one connector, especially to a multi-in-one connector having a retractable structure for switching between different connection interfaces.

2. Description of the Related Art

With the development of technology, many kinds of connectors of peripheral equipments or portable electronic products have been developed for connection with computers. The connectors may connect to the computer through universal serial bus (USB) sockets, SATA sockets, eSATA sockets or IEEE1394 protocol sockets. However, a computer does not provide all those interfaces due to limited space of a computer case. Therefore, a multi-in-one connector socket is developed to be suitable for various connectors without occupying too much space of the computer case.

Most of the computers still keep sockets with single interface since the multi-in-one connector socket is not yet commonly used. Hence, consumers, buying electronic products with incorrect interfaces or cables, usually have to spend more money to buy corresponding adapters or to change sockets of the computer.

To overcome the shortcomings, the present invention provides a multi-in-one connector having a retractable structure for switching between different connection interfaces to mitigate or obviate the aforementioned problems.

SUMMARY OF THE INVENTION

The main objective of the invention is to provide a multi-in-one connector having a retractable structure for switching between different connecting interfaces.

The multi-in-one connector in accordance with the present invention has a casing and a plug assembly. The casing has a cavity and a front opening communicating with the cavity. The plug assembly is mounted in the cavity and extends through the front opening and has a first plug and a second plug. The second plug is separately stacked with the first plug and mounted slidably in the cavity through the front opening, wherein the second plug moves relative to the first plug to extend out of or retract from the front opening. Hence the multi-in-one connector is compatible with at least two connection interfaces of connector sockets.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
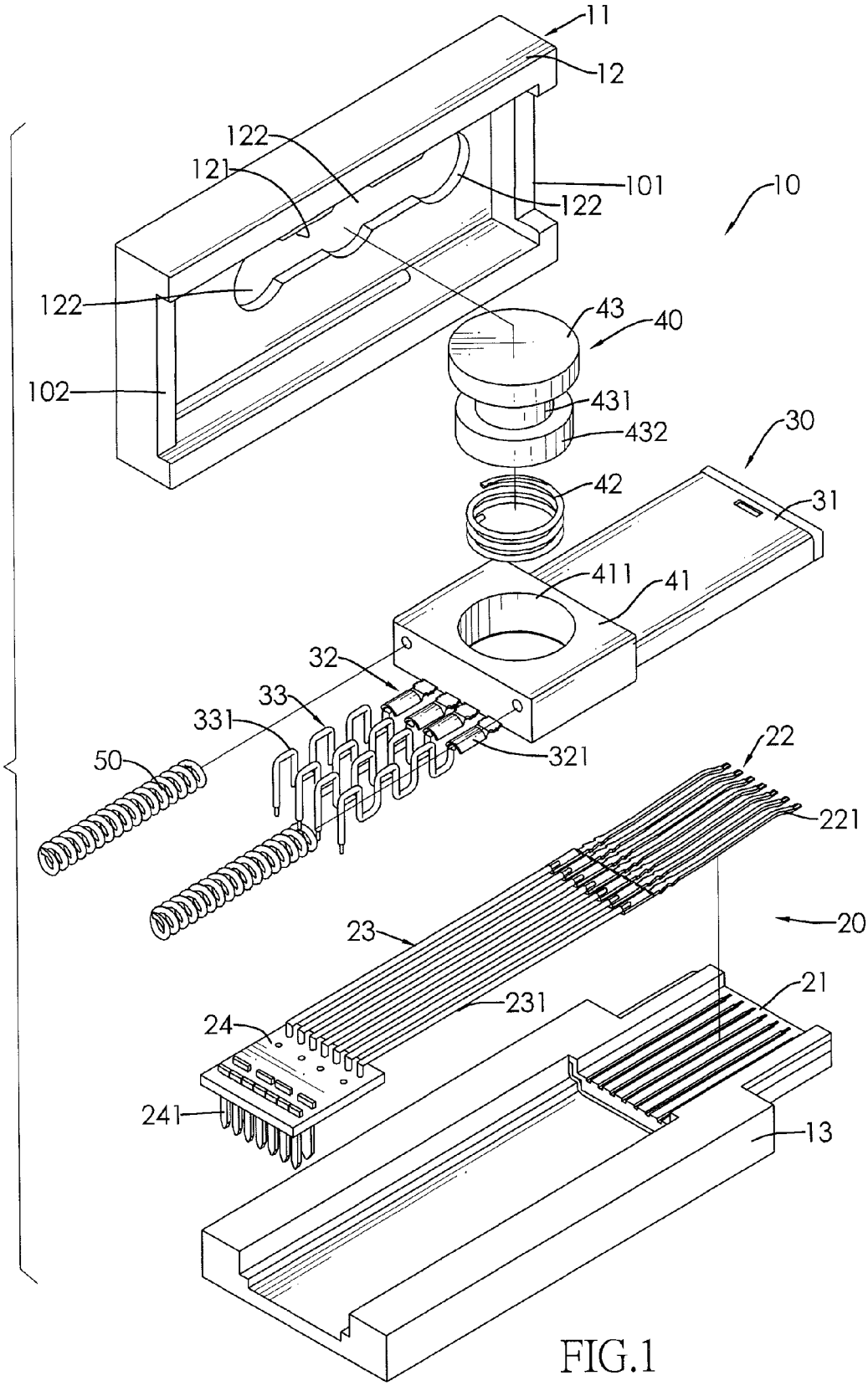
FIG. 1 is an exploded perspective view of a first embodiment of a multi-in-one connector in accordance with the present invention.
Figure 2:
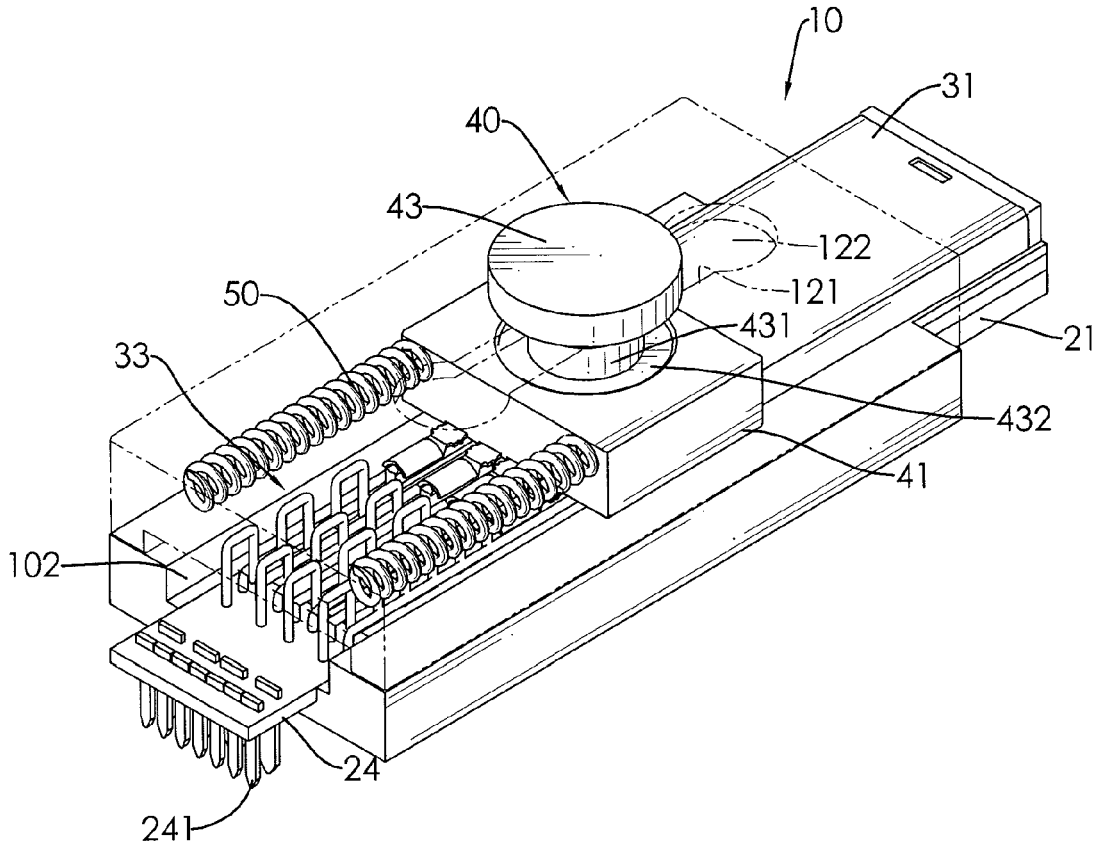
FIG. 2 is a perspective view of the multi-in-one connector in FIG. 1.

With reference to FIGS. 1 and 2, a multi-in-one connector (10) in accordance with the present invention comprises a casing (11) and a plug assembly. The casing (11) has a cavity defined in the casing and a front opening (101) communicating with the cavity. The plug assembly is mounted in the cavity and extends through the front opening (101) and comprises a first plug (20) and a second plug (30). The second plug (30) is slidably mounted in the cavity through the front opening (101), separately stacked with the first plug (20), wherein the second plug (30) moves relative to the first plug (20) to extend out of or retract from the front opening (101).

The casing (11) may have a side opening and a rear opening (102) both communicating with the cavity. In a first embodiment of the present invention, the side opening comprises multiple separated positioning holes (122) and a slide slot (121). The slide slot (121) communicates with the positioning holes (122) and has a width smaller than a diameter of each positioning hole (122). The rear opening (102) is opposite to the front opening (101). The casing (11) may be formed by assembling a top casing unit (12) and a bottom casing unit (13).

The first plug (20) may have a first plug body (21), at least one first contact set (22) and at least one first wire set (23). The first plug body (21) is mounted through the front opening (101) and may be formed on and protrudes from the casing (11) through the front opening (101) and may have an eSATA plug outline or a USB plug outline. In the first embodiment the first plug body (21) has an eSATA outline. The at least one first contact set (22) is mounted on the first plug body (21) and preferably has seven eSATA pins (221) or may have multiple USB pins. The at least one first wire set (23) is disposed in the cavity and connected to the at least one first contact set (22) and preferably includes seven wires (231) for respectively connected to the eSATA pins (221) of the at least one first contact set (22). The at least one first wire set (23) may be exposed from the rear opening (102) and electrically connected to a plugboard (24) in the rear opening (102). The plugboard (24) has multiple pins (241) for connected to a circuit board of an electronic device.

The second plug (30) may have a second plug body (31), at least one second contact set (32) and at least one extendable second wire set (33). The second plug body (31) is mounted slidably in the cavity through the front opening (101) and may have an eSATA outline or a USB outline. Preferably the second plug body (31) has a USB outline in the first embodiment. The at least one second contact set (32) is mounted on a bottom surface of the second plug body (31), faces the at least one first contact set (22) and may have multiple USB 2.0 contacts (321) or multiple USB 3.0 contacts or have both. Or the at least one second contact set (32) may have multiple eSATA contacts. The at least one extendable second wire set (33) is disposed in the cavity and connected to the at least one second contact set (32) and may include four wires (331) for connecting to the USB 2.0 contacts (321) of the at least one second contact set (32). The wires (331) of the extendable second wire set (33) are longer than the wires (231) of the first wire set (23) and each wire (331) of the extendable second wire set (33) has one end exposed from the rear opening (102) for connecting to the plugboard (24).

In the first embodiment, the multi-in-one connector may further comprise a release device (40) The release device (40) is mounted on the second plug body (31) of the second plug (30) through the side opening of the casing (11) and has a base (41), a second spring (42) and a positioning member (43). The base (41) is mounted on the second plug body (31), corresponds in position to the slide slot (121) and has a recess (411). The second spring (42) is mounted in the recess (411) of the base (41). The positioning member (43) has a neck portion (431) and a bottom portion (432). The neck portion (431) is thinner than the width of the slide slot (121) for the positioning member (43) to slide back and forth in the slide slot (121). The bottom portion (432) is connected to the neck portion (431), presses against the second spring (42) and has a diameter corresponding to that of each positioning hole (122). The positioning member (43) may be fixed when being engaged with any of the positioning holes (122) and the engagement may be released (122) by pressing the positioning member (43) to slide backward or forward in the slide slot (121) with the neck portion (431) extending into the slide slot (121).

In order to facilitate operation of the release device (40), the multi-in-one connector (10*a*) may further comprise at least one first spring (50). The at least one first spring (50) is mounted between the second plug body (31) and a rear inner wall of the casing (11) where the rear opening (102) is formed and thereby provides a force that pushes the second plug (30) forward.

Figure 3:
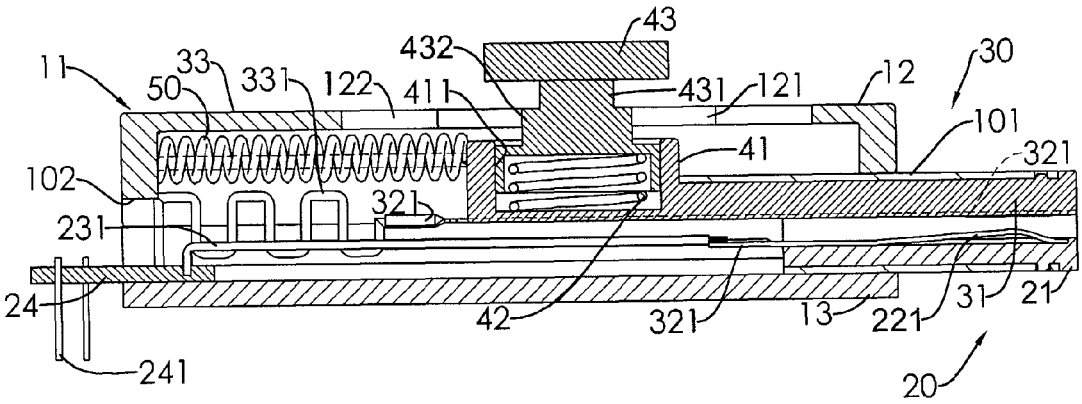
FIG. 3 is a cross sectional side view of the multi-in-one connector in FIG. 2.
Figure 4A:
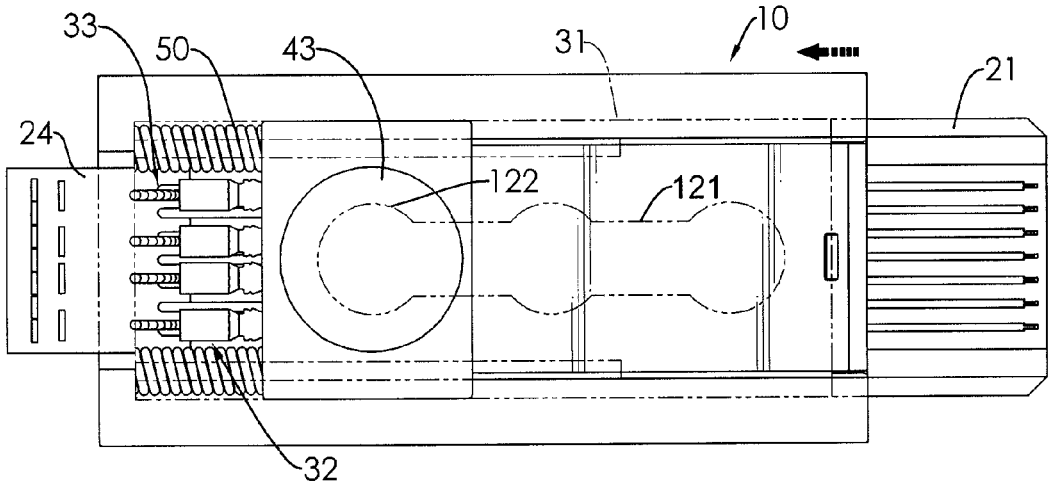
FIGS. 4A and 4B are operational top views of the multi-in-one connector in FIG. 2.
Figure 4B:
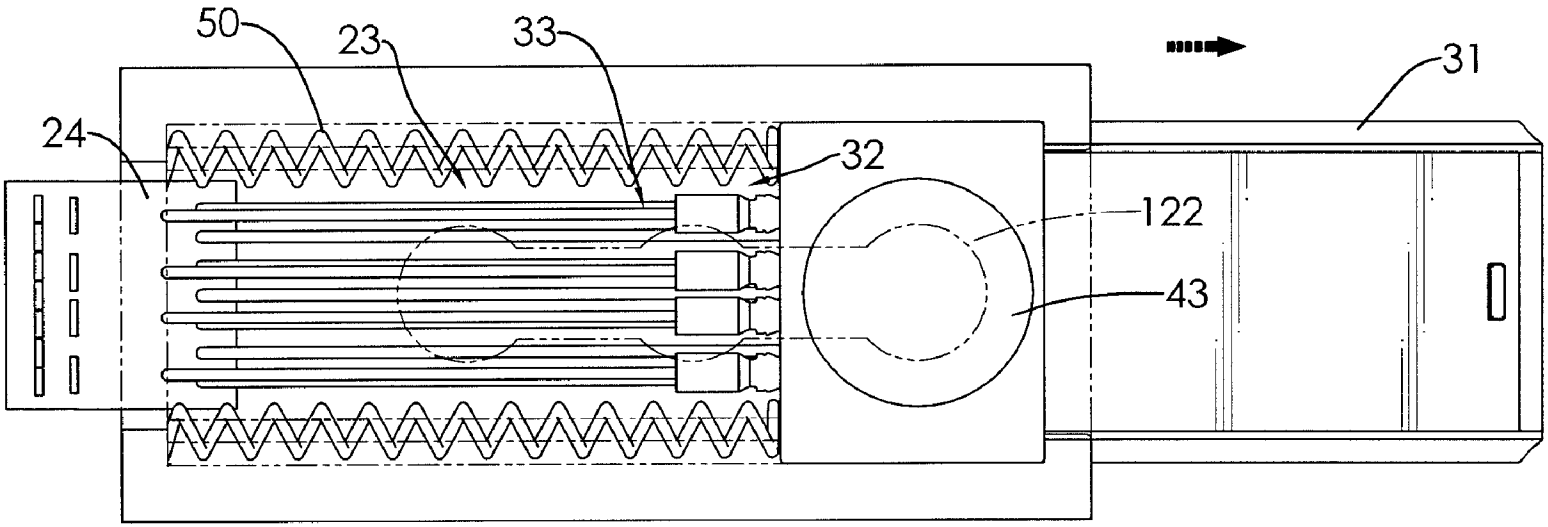

With further reference to FIG. 3, when the positioning member (43) is engaged with the middle one of the positioning holes (122), the first plug (20) and the second plug (30) forms a multi-in-one connector for inserting to a multi-in-one connector socket. With reference to FIG. 4A, a user can press and push the positioning member (43) backward to engaged with the rear one of the positioning holes (122) to retract the second plug (30) from the front opening (101), hence the first plug (20) can be directly inserted into an eSATA socket. With further to FIG. 4B, the user can also press and push the positioning member (43) forward to engaged with the front one of the positioning holes (122) to extend the second plug (30) from the front opening (102) over the first plug (20), hence the second plug (30) can be directly inserted into another type of connector socket, such as a USB socket. Therefore, the multi-in-one connector is not limited in connection with one single type connect socket.

Figure 5:
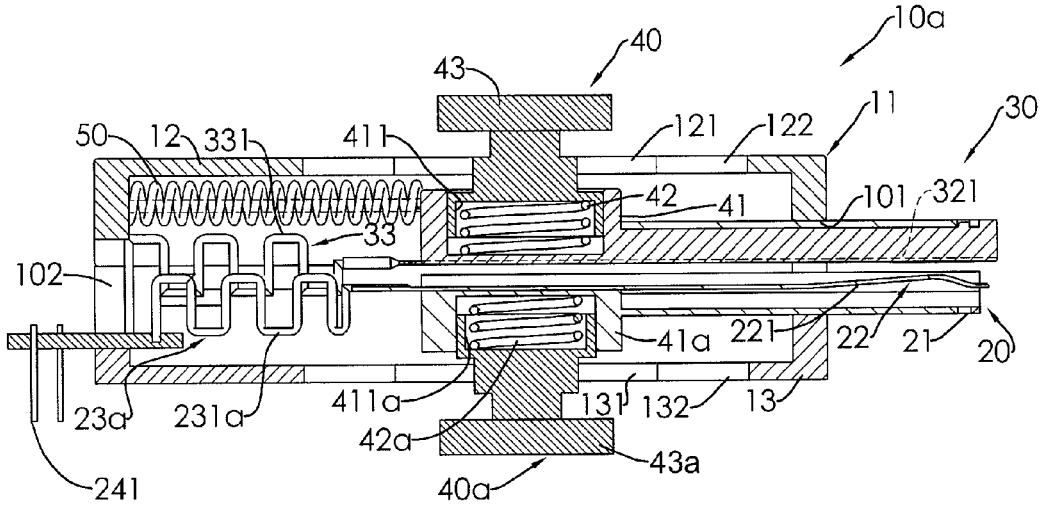
FIG. 5 is a side view in partial section of a second embodiment of the multi-in-one connector.

With further reference to FIG. 5, in a second embodiment of the present invention, the first plug (20) is also slidably mounted in the cavity through the front opening (101), wherein the multi-in-one connector (10*a*) further has a second release device (40*a*) and the casing (11) further has a second side opening communicating with the cavity of the casing (11) and opposite to the side opening. The second side opening also comprises multiple separated second positioning holes (132) and a second slide slot (131), wherein the second slide slot (131) communicates with the second positioning holes (132) and has a width smaller than a diameter of each second positioning hole (132).

The second release device (40*a*) is mounted on the first plug body (21) of the first plug (20) through the first side opening of the casing (11) and has a second base (41*a*), a fourth spring (42*a*) and a second positioning member (43*a*). The second base (41*a*) is mounted on the first plug body (31), corresponds in position to the second slide slot (131) and has a second recess (411*a*). The fourth spring (42*a*) is mounted in the second recess (411*a*) of the second base (41*a*). The second positioning member (43*a*) has a second neck portion and a second bottom portion. The second neck portion is thinner than the width of the second slide slot (131) for the second positioning member (43) to slide back and forth in the first slide slot (131). The second bottom portion is connected to the second neck portion, presses against the fourth spring (42*a*) and has a diameter corresponding to that of each second positioning hole (132). Therefore, like the second plug (30), the first plug (20) can also be retracted from or extended out of the opening (101) by pressing and pushing the second positioning member (43*a*) backward or forward in the second slide slot (131). Furthermore, in the second embodiment, the at least one first wire set (23) may be an extendable first wire set (23*a*) comprising multiple wires (231*a*).

Figure 6:
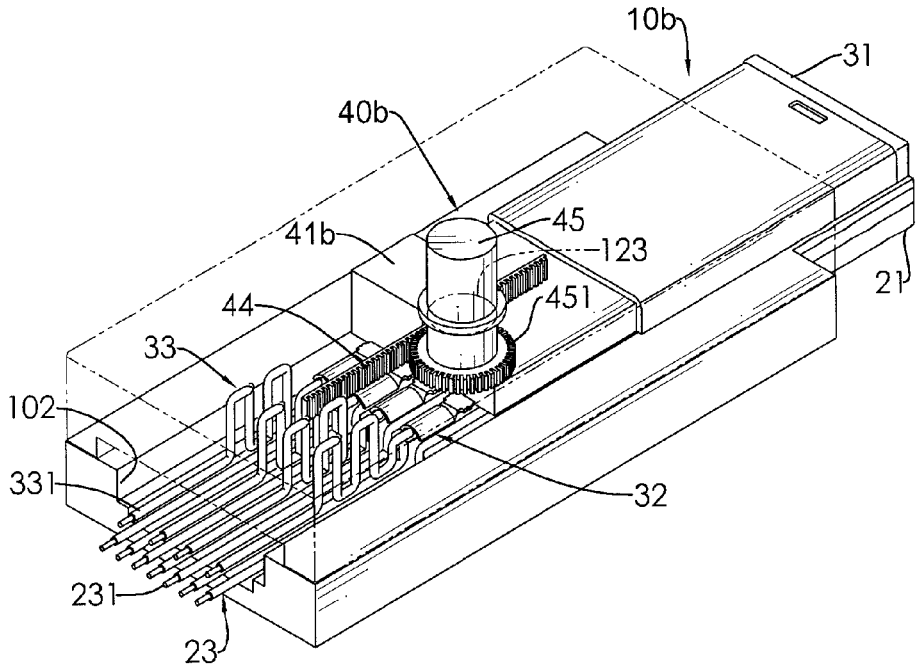
FIG. 6 is a perspective view of a third embodiment of the multi-in-one connector.
Figure 7:
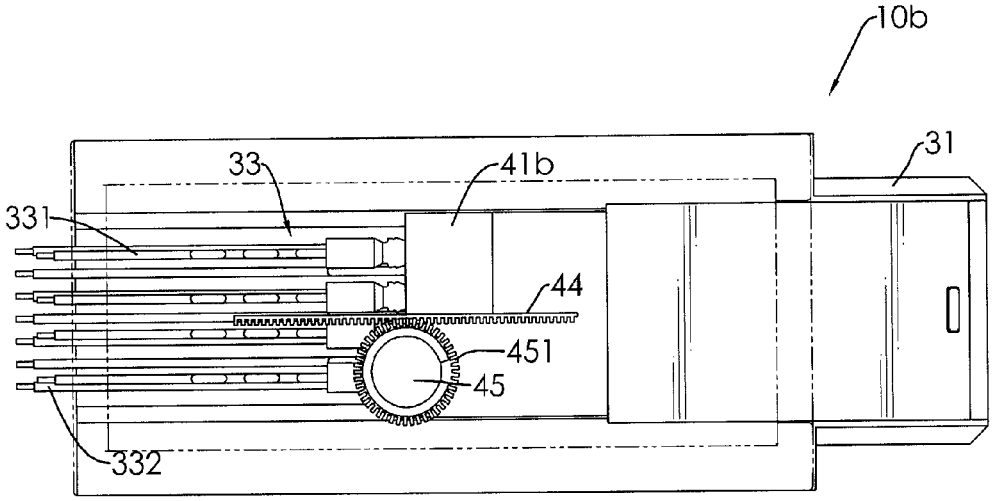
FIG. 7 is top view of the multi-in-one connector in FIG. 6.

With further reference to FIGS. 6 and 7, in a third embodiment of a multi-in-one connector (10*b*) of the present invention, the side opening of the casing (11) comprises a through hole (123) instead of the slide slot (121) and the positioning holes (122) in FIG. 1. And the release device (40*b*) comprises a base (41*b*), a rack (44) and a turning knob (45). The base (41*b*) is mounted on the second plug body (31) and beside the through hole (123). The rack (44) is mounted on a sidewall of the base (41*b*) beside the through hole (123). The turning knob (45) is mounted through the through hole (123) of casing (11) and has a gear portion (451) meshed with the rack (44).

Because the rack (44) is fixed to the base (41*b*), as a user turns the turning knob (45), the gear portion (451) of the turning knob (45) would push or draw the base (41*b*) via a meshed gear relationship and thereby retract or extend the second plug body (31). Besides, in the third embodiment, the at least one first wire set (23) and the at least one extendable wire set (33) are directly exposed outside the rear opening (102) of the casing (11) for directly connection to a circuit board of an electronic device without using a plugboard.

Figure 8:
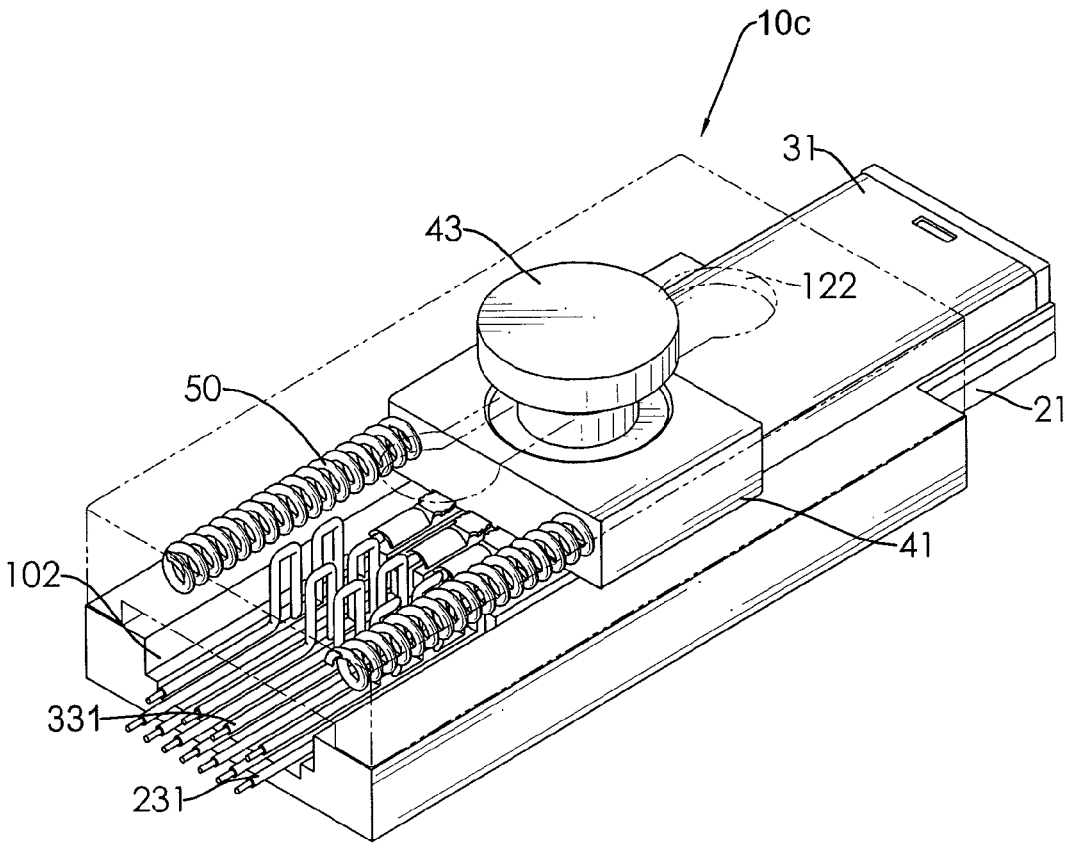
FIG. 8 is a perspective view of a fourth embodiment of the multi-in-one connector.

With reference to FIG. 8, in a fourth embodiment of the multi-in-one connector (10*c*) that is similar in structure to the first embodiment, the difference is that wires (231) of the at least one first wire set (23) and wires (331) of the at least one extendable wire set (33) are directly exposed outside the rear opening (102) of the casing (11) for directly connection to a circuit board of an electronic device without using a plugboard.

Figure 9:
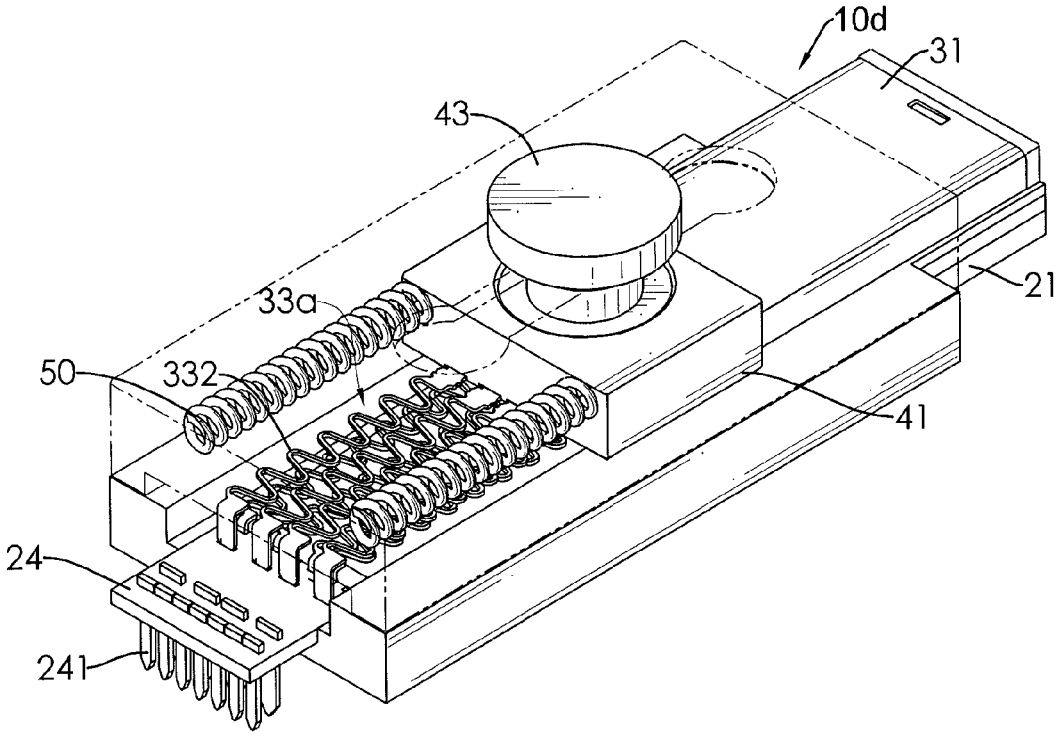
FIG. 9 is a perspective view of a fifth embodiment of the multi-in-one connector.
Figure 10:
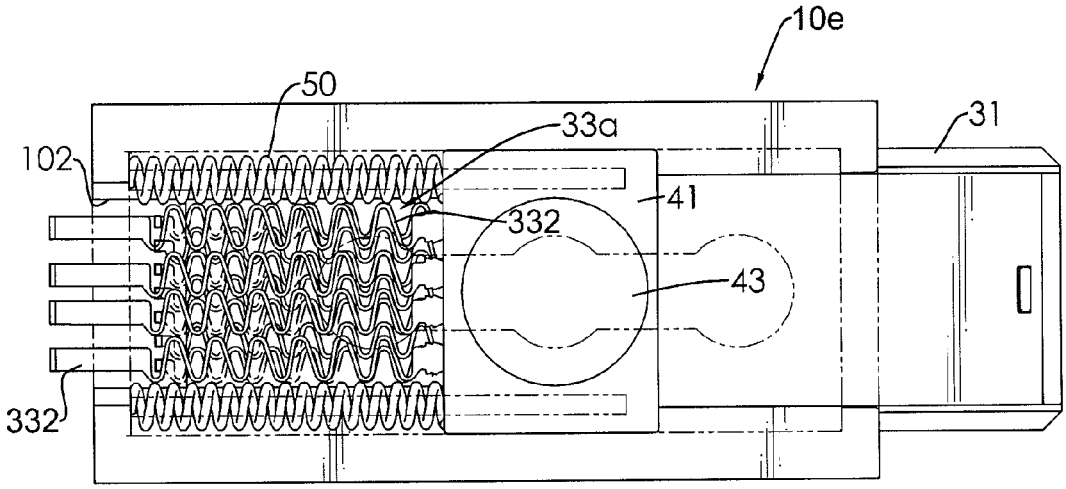
FIG. 10 is a top view of a sixth embodiment of the multi-in-one connector.

With reference to FIG. 9, in a fifth embodiment of the multi-in-one connector (10*d*), the at least one extendable second wire set (33*a*) comprises multiple winding metal strips (332) that are deformable. Each of the winding metal strips (332) has one end connected to a corresponding contact of the at least one second contact set (32) and another end soldered to the plugboard (24). With further reference to FIG. 10, a sixth embodiment of a multiple-in-one connector (10*e*) shows that the metal strips (332) are directly exposed from the rear opening (102) for being directly soldered on a circuit board of an electronic device without the plugboard (24).

Figure 11:
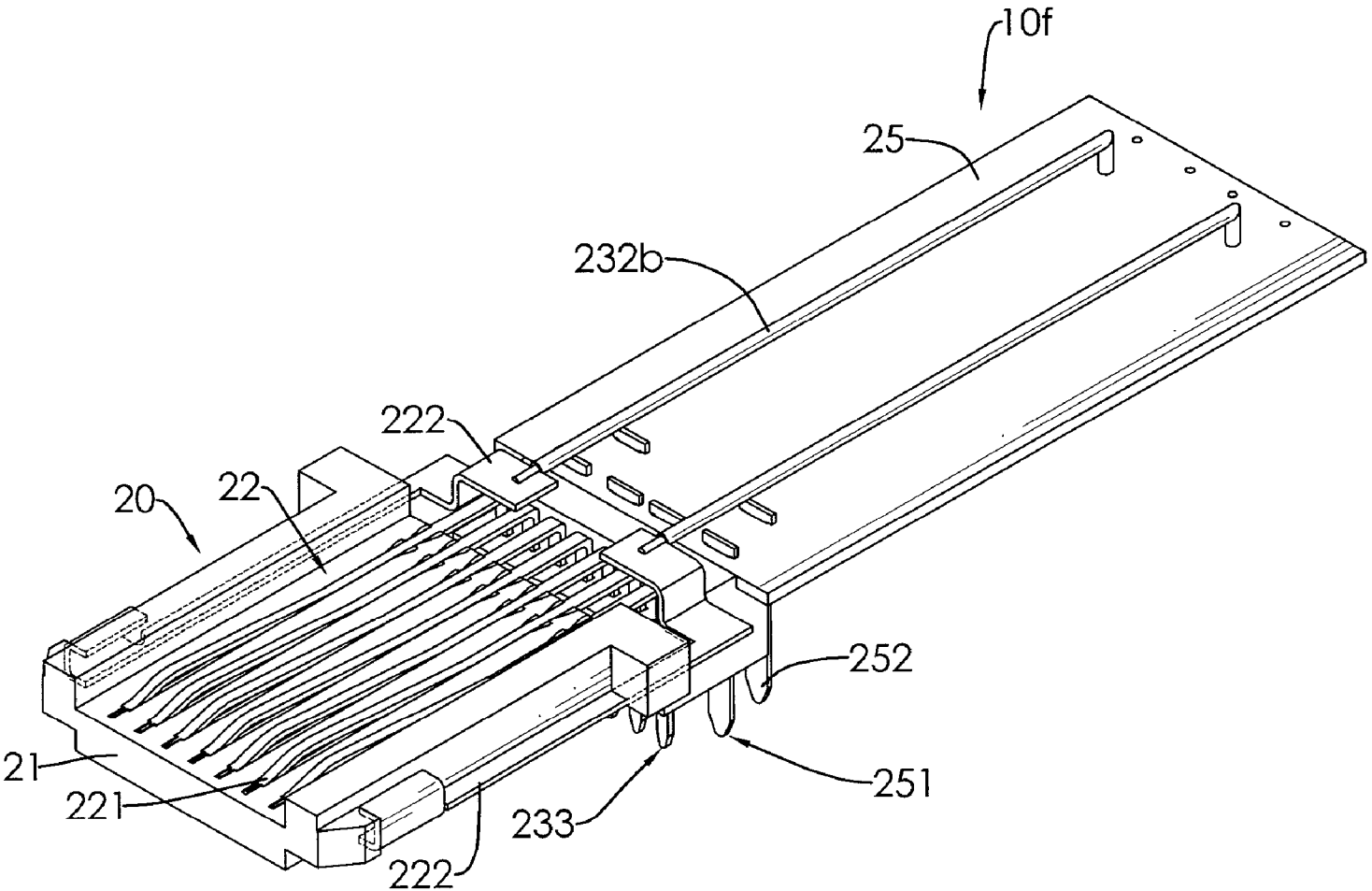
FIG. 11 is a perspective view of a first plug of a seventh embodiment of the multi-in-one connector.
Figure 12:
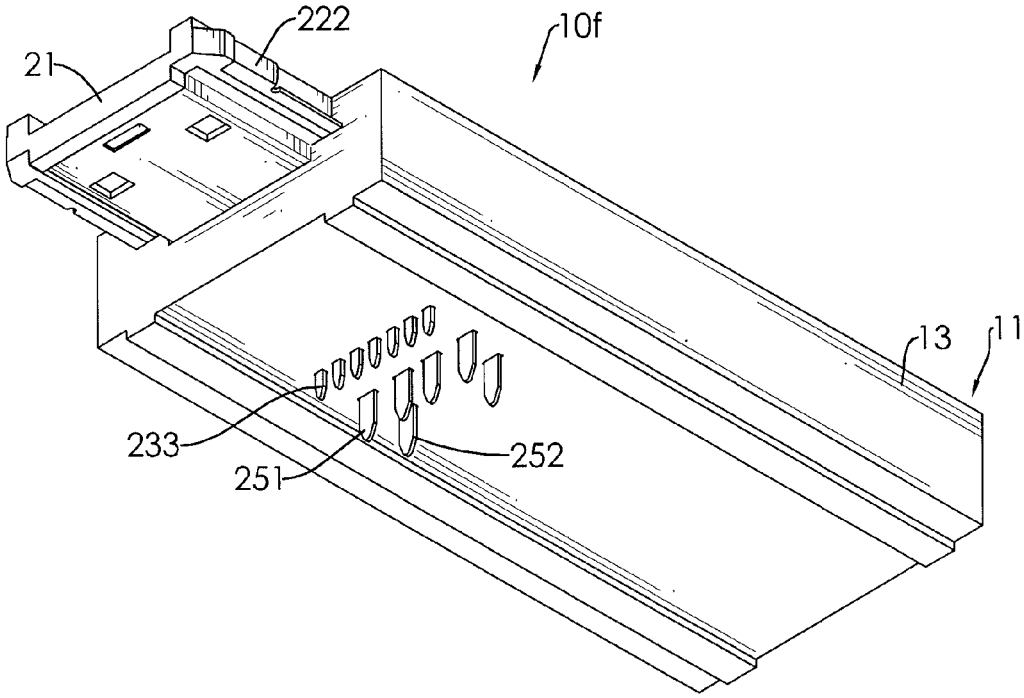
FIG. 12 is a bottom perspective view of the seventh embodiment of the multi-in-one connector.

With further reference to FIGS. 11 and 12, in a seventh embodiment of the multi-in-one connector (10*f*), the at least one first contact set (22) comprises an electrified eSATA contact set having seven or nine contacts and two power contacts (222), preferably seven contacts (221) and two power contacts (222) are implemented. The at least one first wire set (23) may have seven L-shaped pins (233) corresponding to the contacts (221) of the at least one first contact set (22) and protruding through a bottom surface of the casing (11) to be exposed outside the casing (11). The power contacts (222) are respectively mounted on two opposite sides of the first plug body (21) and electrically connected to a plugboard (25) via a wire (232*b*) or a winding metal strip. The plugboard (25) may have a front end close to the at least one first contact set (22) and having multiple pins (251) (252) mounted on the front end of the plugboard (25) and protruding downward through the bottom surface of the casing (11). The pins (251) (252) are correspondingly connected to at least one extendable second wire set (33) and the power contacts (222). Hence in the seventh embodiment, a rear opening is not necessary.

Figure 13:
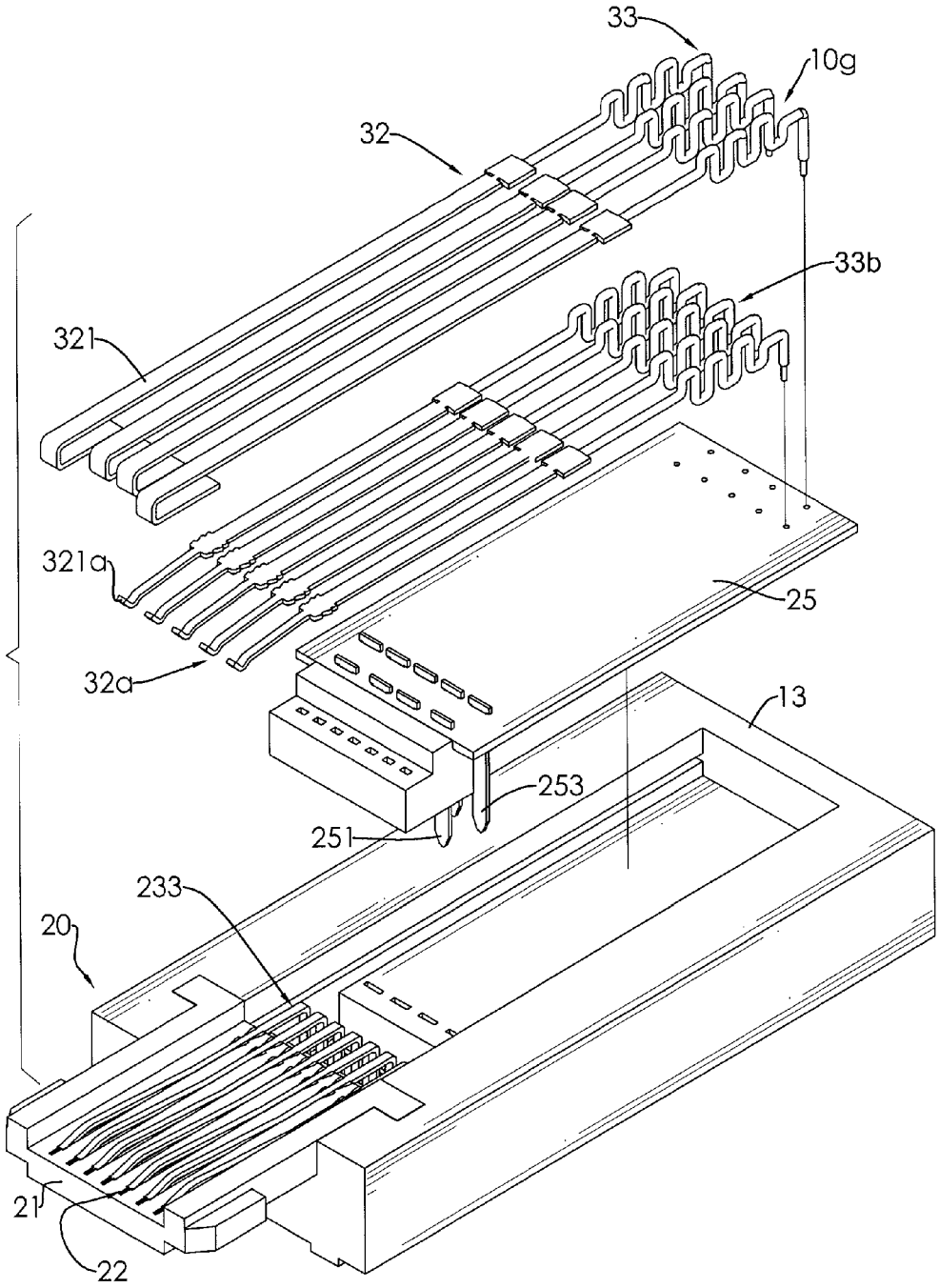
FIG. 13 is an exploded perspective view of an eighth embodiment of the multi-in-one connector with a top cover shown removed.
Figure 14:
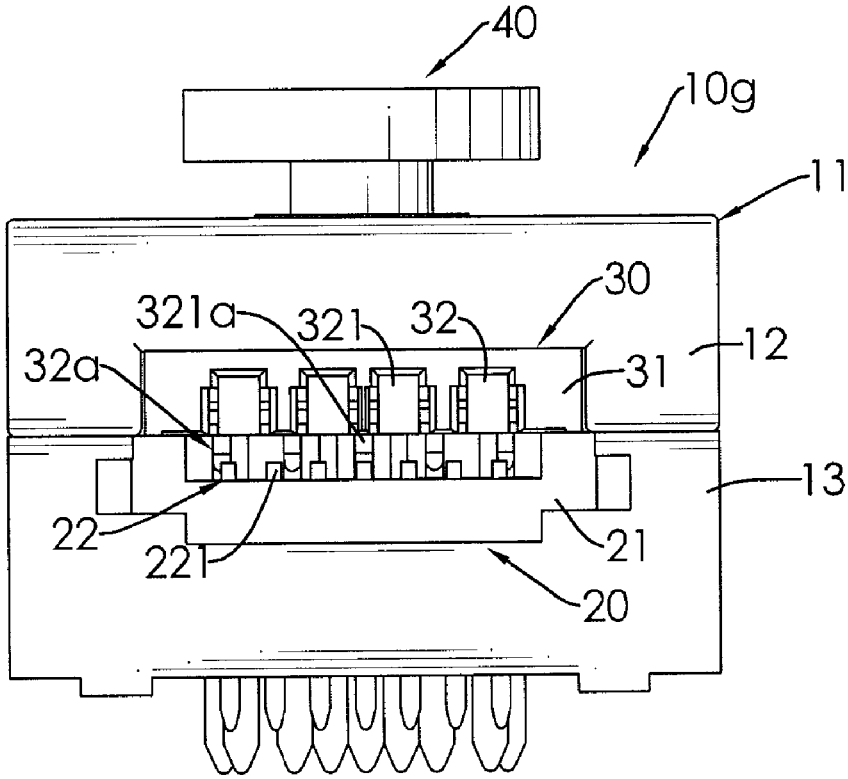
FIG. 14 is a front view of the eighth embodiment of the multi-in-one connector.

With further reference to FIGS. 13 and 14, in an eighth embodiment of a multi-in-one connector (10*g*), the at least one second contact set (32, 32*a*) includes a USB 2.0 contact set (32) and a USB 3.0 contact set (32*a*), wherein the USB 2.0 contact set (32) has four contacts (321) and the USB 3.0 contact set (32*a*) has nine contacts (321*a*, 321) including the four contacts (321) of the USB 2.0 contact set (32), wherein the four contacts (321) of the USB 2.0 contact set (32) and the other five contacts (321*a*) are staggered. Therefore, in this embodiment, the second plug (30) has two extendable second wire sets (33, 33*b*). Besides, the multi-in-one connector (10*g*) further has a plugboard (25) mounted between the at least one first contact set (22) and a rear inner wall of the casing (11). The plugboard (25) has a rear end, a front end and multiple pins (251, 253). The rear end is close to the rear inner wall of the casing (11) and electrically connected to the extendable second wire sets (33, 33*b*). The front end is close to the at least first contact set (22). The pins (251, 253) are mounted on the front end of the plugboard (25), correspondingly and electrically connected to the extendable second wire sets (33, 33*b*) and protrude downward through a bottom surface of the casing (11). Therefore a rear opening is also unnecessary in the eighth embodiment.

Figure 15:
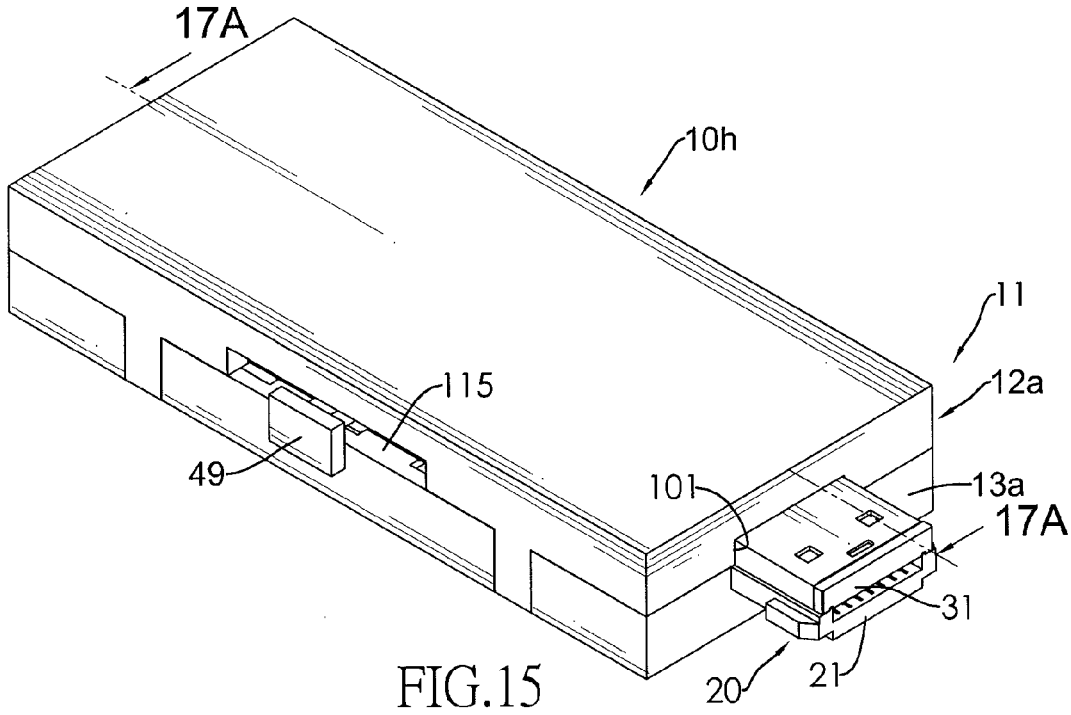
FIG. 15 is a perspective view of a ninth embodiment of the multi-in-one connector.
Figure 16:
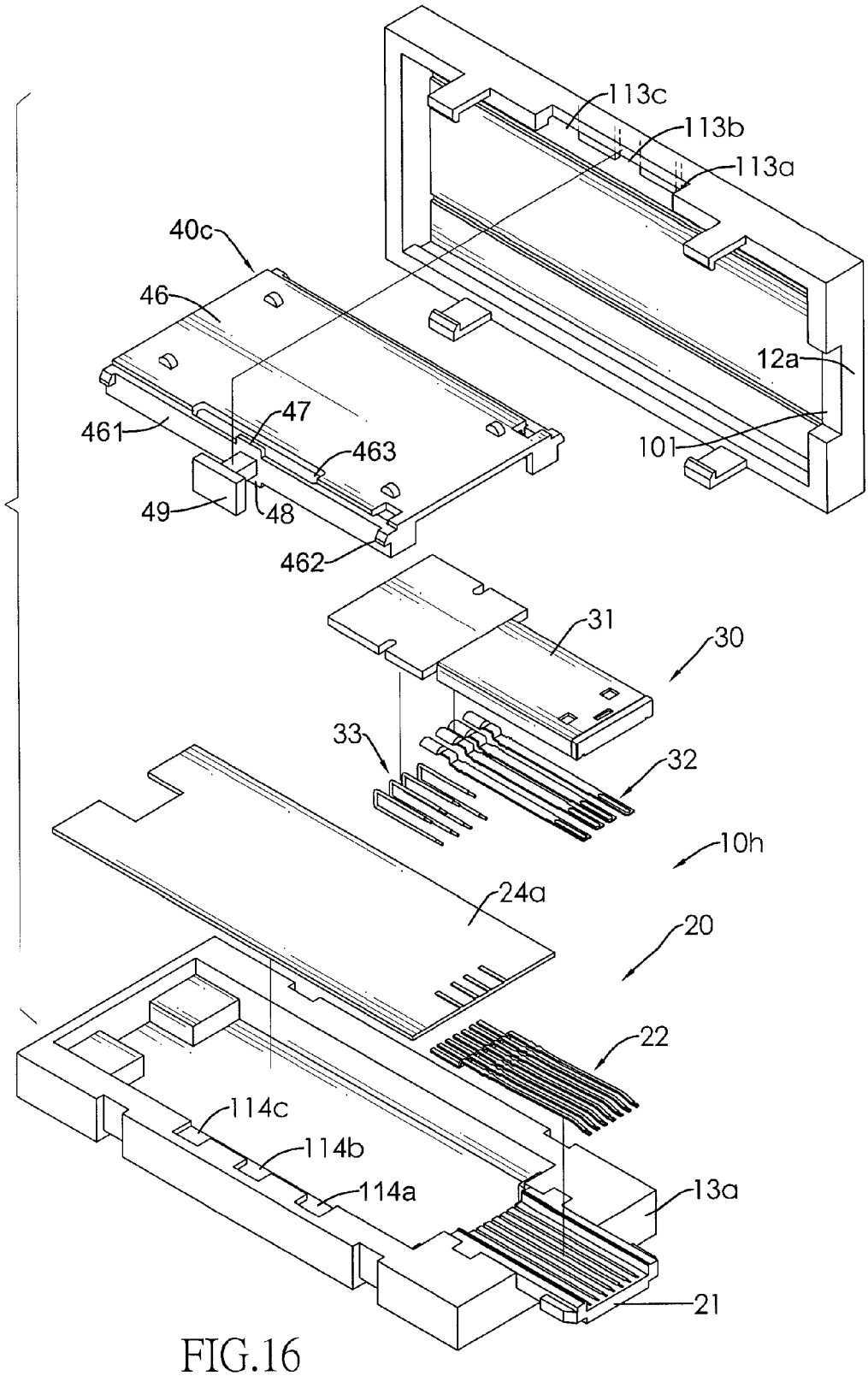
FIG. 16 is an exploded perspective view of the multi-in-one connector in FIG. 15.

With further reference to FIGS. 15 and 16, in a ninth embodiment of the multi-in-one connector (10*h*) that is structurally similar to the first embodiment, wherein the difference is that the side opening of the casing (11) comprises an elongated hole (115). The elongated hole (115) is formed through a wall between the top casing unit (12*a*) and the bottom casing unit (13*a*) of the casing (11). Each of the top casing unit (12*a*) and bottom casing unit (13*a*) has three positioning notches (113*a*~113*c*)(114*a*~114*c*) formed on the wall corresponding in position to the elongated hole (115). The release device (40*c*) is mounted through the elongated hole (115). With further reference to FIG. 16, the plugboard (24*a*) is mounted in the cavity of the casing (11), disposed between the first plug (20) and the second plug (30), electrically connected to the at least one first contact set (22) of the first plug (20) and electrically connected to the at least one extendable second contact set (32) via the at least one extendable second wire set (33).

Figure 18A:
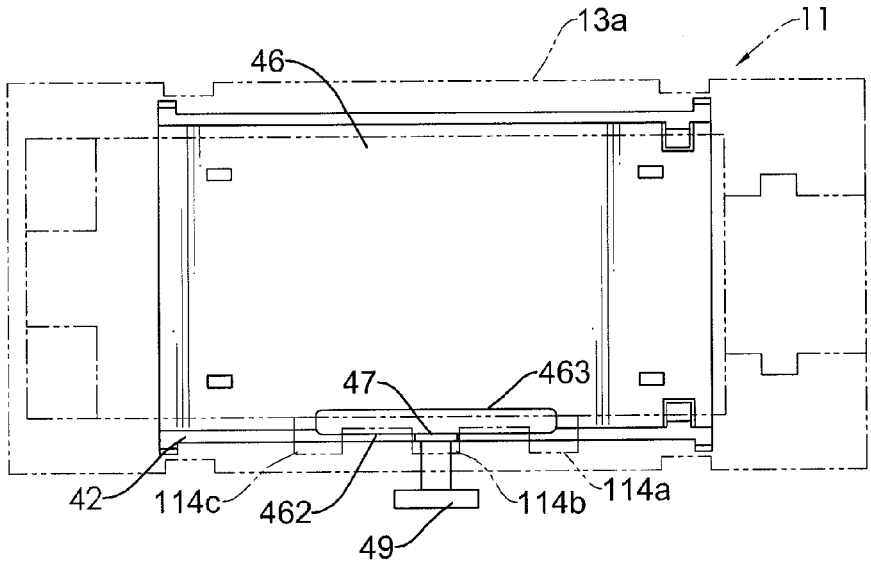
FIG. 18A is a top view of the multi-in-one connector in FIG. 15 with a top cover shown removed.
Figure 18B:
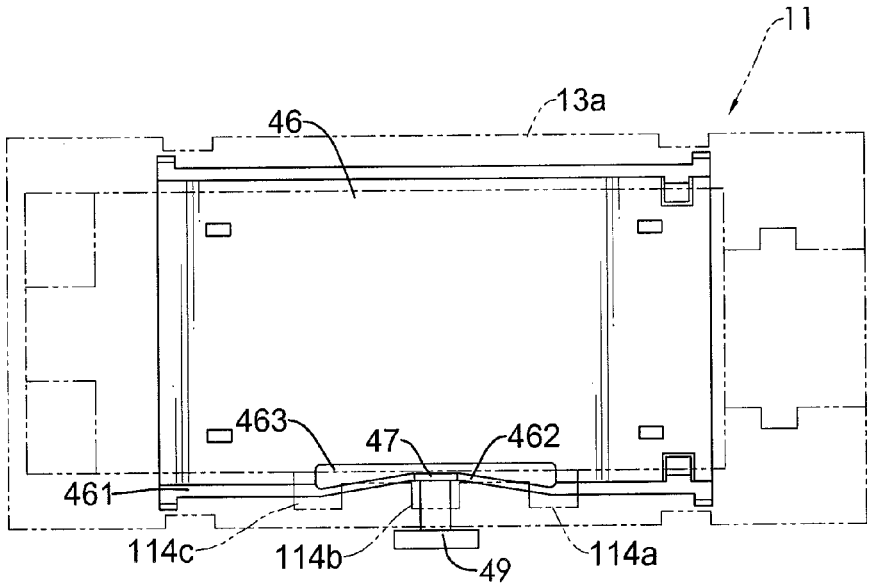
FIG. 18B is an operational top view of a third embodiment of the multi-in-one connector with a top cover shown removed.

With further reference to FIGS. 16 and 18A, the release device (40*c*) in the ninth embodiment comprises a panel (46) and a push member (49). The panel (46) is disposed on and connected to the second plug (30) and has a longitudinal sidewall (461), a longitudinal slot (463) and a resilient sheet (462). The longitudinal sidewall (461) faces the elongated hole (115). The longitudinal slot (463) is formed through the panel (46) adjacent to and parallel to the longitudinal sidewall (461). The resilient sheet (462) is formed on the longitudinal sidewall (461) and corresponds in position to the longitudinal slot (463). The push member (49) is mounted on the resilient sheet (462) and protrudes from the elongated hole (115) of the casing (11). With reference to FIG. 18B, when pressing the push member (49), the longitudinal slot (463) provides a room for pushing the resilient sheet (462) and the push member (49) is able to move forward or backward relative to the top casing unit (12*a*) and the bottom casing unit (13*a*).

Figure 17A:
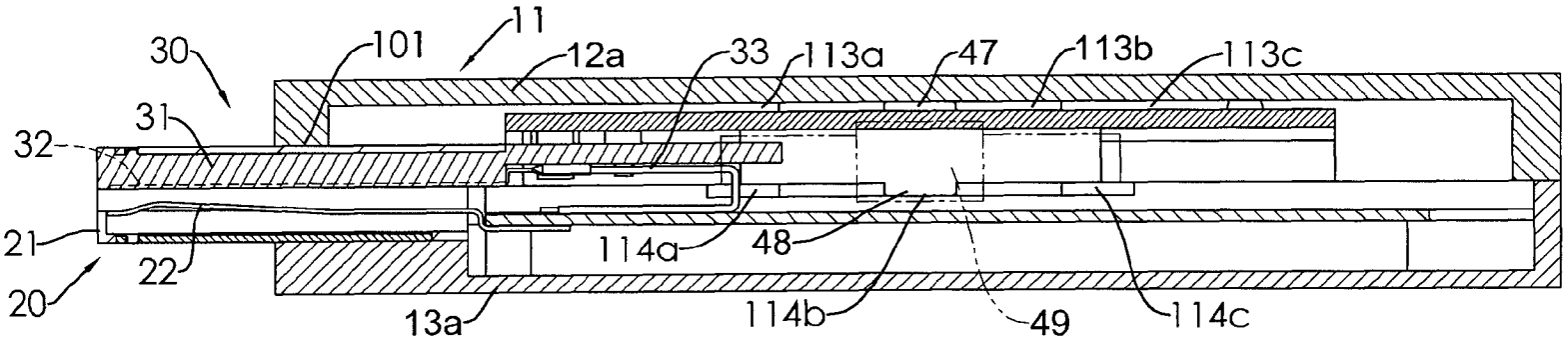
FIG. 17A is a side view in partial section of the multi-in-one connector in FIG. 15.
Figure 17B:
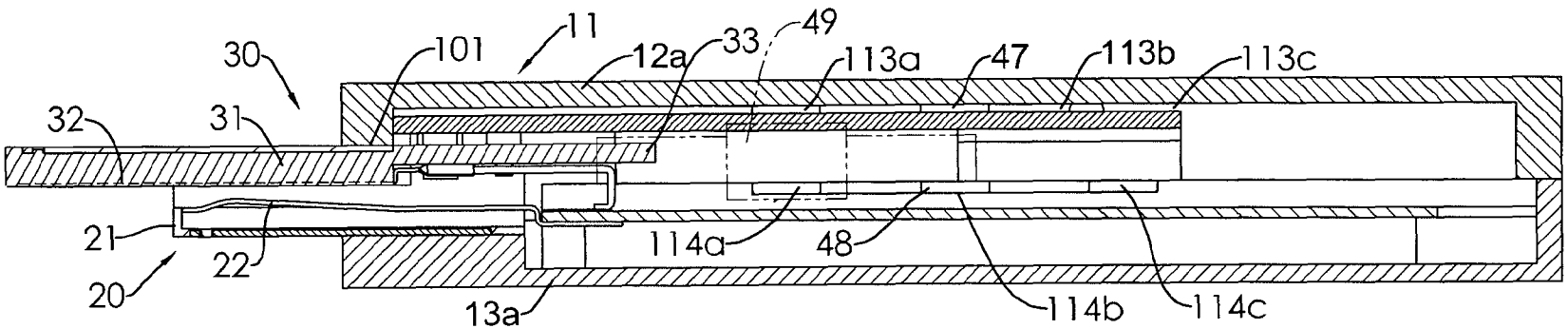
FIGS. 17B and 17C are operational side views in partial section of the multi-in-one connector in FIG. 15.

Furthermore, with reference to FIG. 17A, the panel (46) further has an upper tab (47) and a lower tab (48). The upper tab (47) is formed on and protrudes upward from the longitudinal sidewall (461), corresponds in position to the push member (49) and is selectively engaged with one of the positioning notches (113*a*~113*c*). The lower tab (48) is formed on and protruding downward from the longitudinal sidewall (461), corresponds in position to the push member (49) and is selectively engaged with a corresponding positioning notch (114*a*~114*c*) opposite to the upper tab (47). With those positioning notches (113*a*~113*c*) (114*a*~114*c*), the push member (49) can be positioned in a rear, middle and front position by engaging the upper and lower tabs (47, 48) with the positioning notches (113*a*~113*c*) (114*a*~114*c*). Pushing the push member (49) disengages the upper and lower tabs (47, 48) from the positioning notches (113*a*~113*c*)(114*a*~114*c*).

Figure 19:
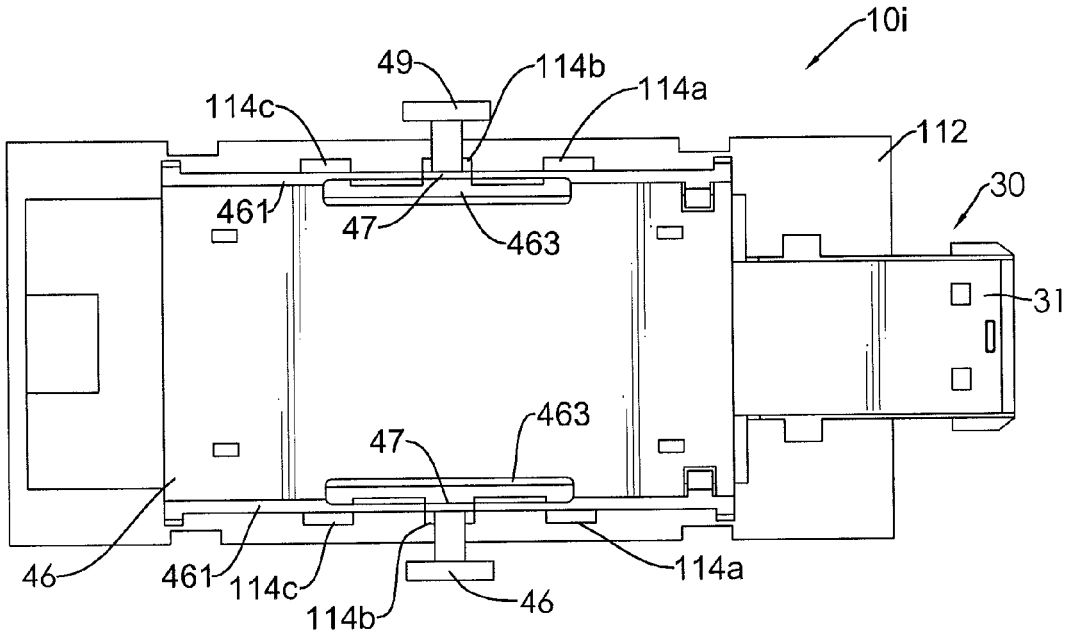
FIG. 19 is a top view of a tenth embodiment of the multi-in-one connector with a top cover shown removed.

With further reference to FIG. 19, in a tenth embodiment of a multi-in-one connector (10*i*) that is structurally similar to the ninth embodiment, the difference is the casing (11) has two walls, two opposite elongated holes respectively formed through the walls and three positioning notches (114*a*~114*c*) formed on each wall, and the panel (46) has two opposite longitudinal sidewalls (461), two longitudinal slots (463), two upper tabs (47) and two lower tabs. The longitudinal sidewalls (461) respectively face the elongated holes, connect a push member (49). The longitudinal slots (463) are formed through the panel (46) respectively adjacent to and parallel to the longitudinal sidewalls (461). The upper tabs (47) and the lower tabs are respectively formed on and protrude upward from the longitudinal sidewalls (461), correspond in position to the push members (49) and are selectively engaged with a corresponding positioning notch (114*a*~114*c*). The push members (49) respectively extend through the elongated hole.

With further reference to FIG. 17A, when the upper and lower tabs (47, 48) are engaged with middle positioning notches (113*b*, 114*b*), the multi-in-one connector (10*i*) is adapted to connect a multi-in-one socket, wherein the first plug body (21) and the second plug body (31) are exposed from the front opening (101) and aligned to each other in position.

Figure 17C:
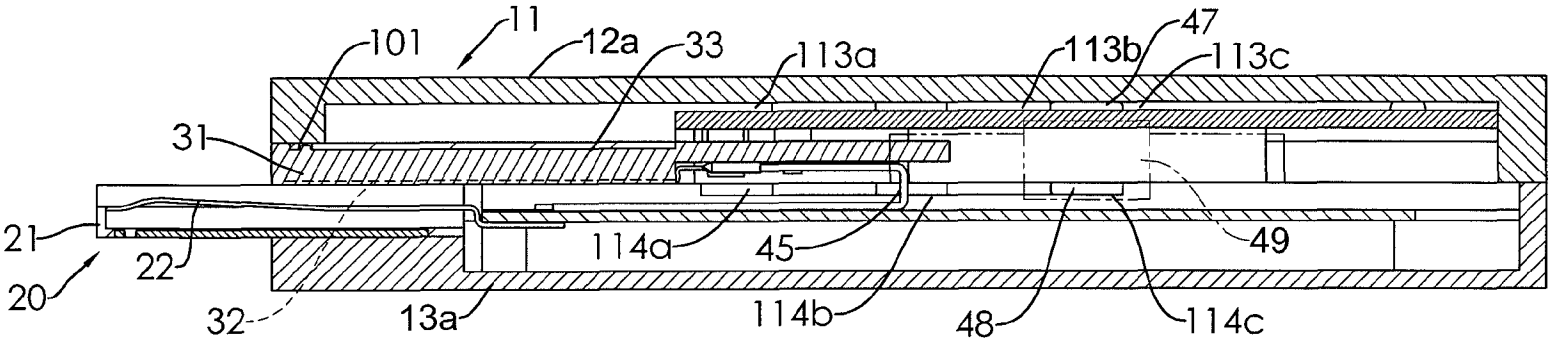

With further reference to FIGS. 18B and 17C, by pressing the push member (49), the longitudinal sidewall (461) may deform and release the upper and lower tabs (47, 48) from the middle positioning notches (113*b*, 114*b*). Then push the push member (49) backward to the rear positioning notches (113*c*, 114*c*) and release the push member (49) to engage the upper and lower tabs (47, 48) with the rear positioning notches (113*c*, 114*c*). The second plug body (31) is then retracted into the cavity of the casing (11) and the first plug body (21) remains outside the casing (11) and is adapted to connect an eSATA socket. Since the release device (40) is mounted through a narrow side of the casing (11), the multi-in-one connector (10*h*, 10*i*) can be made thinner.

Figure 20:
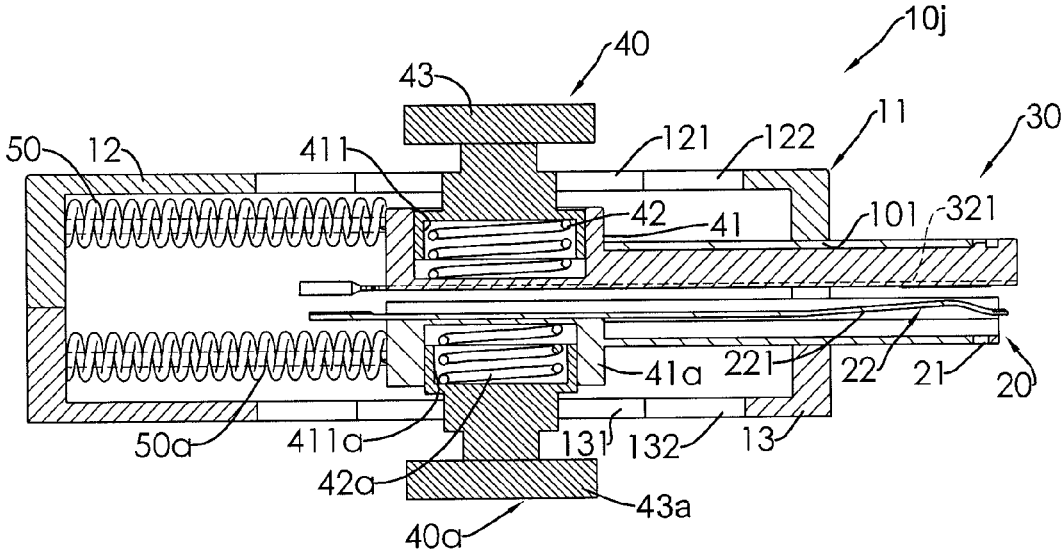
FIG. 20 is a side view in partial section of an eleventh embodiment of the multi-in-one connector.

With further reference to FIG. 20, in an eleventh embodiment of a multi-in-one connector (10*j*) that is structurally similar to the second embodiment in FIG. 5 however the multi-in-one connector (10*j*) further has at least one third spring (50*a*). The at least one third spring (50*a*) is mounted between the first plug body (21) and a rear inner wall of the casing (11) where the rear opening (102) is formed and thereby provides a force that pushes the first plug (20) forward.

Figure 21:
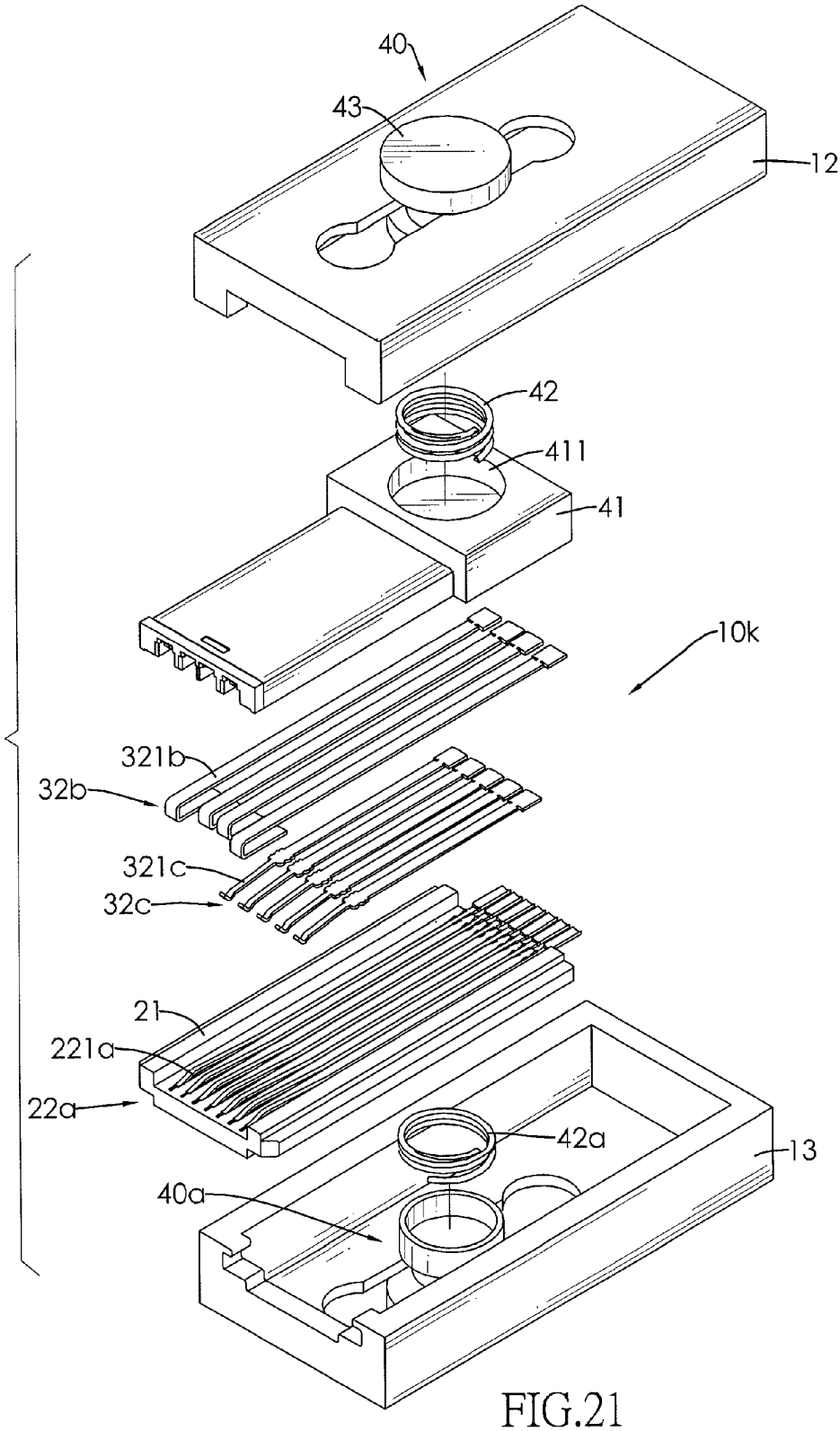
FIG. 21 is a partial exploded perspective view of a twelfth embodiment of a multi-in-one connector in accordance with the present invention.
Figure 22:
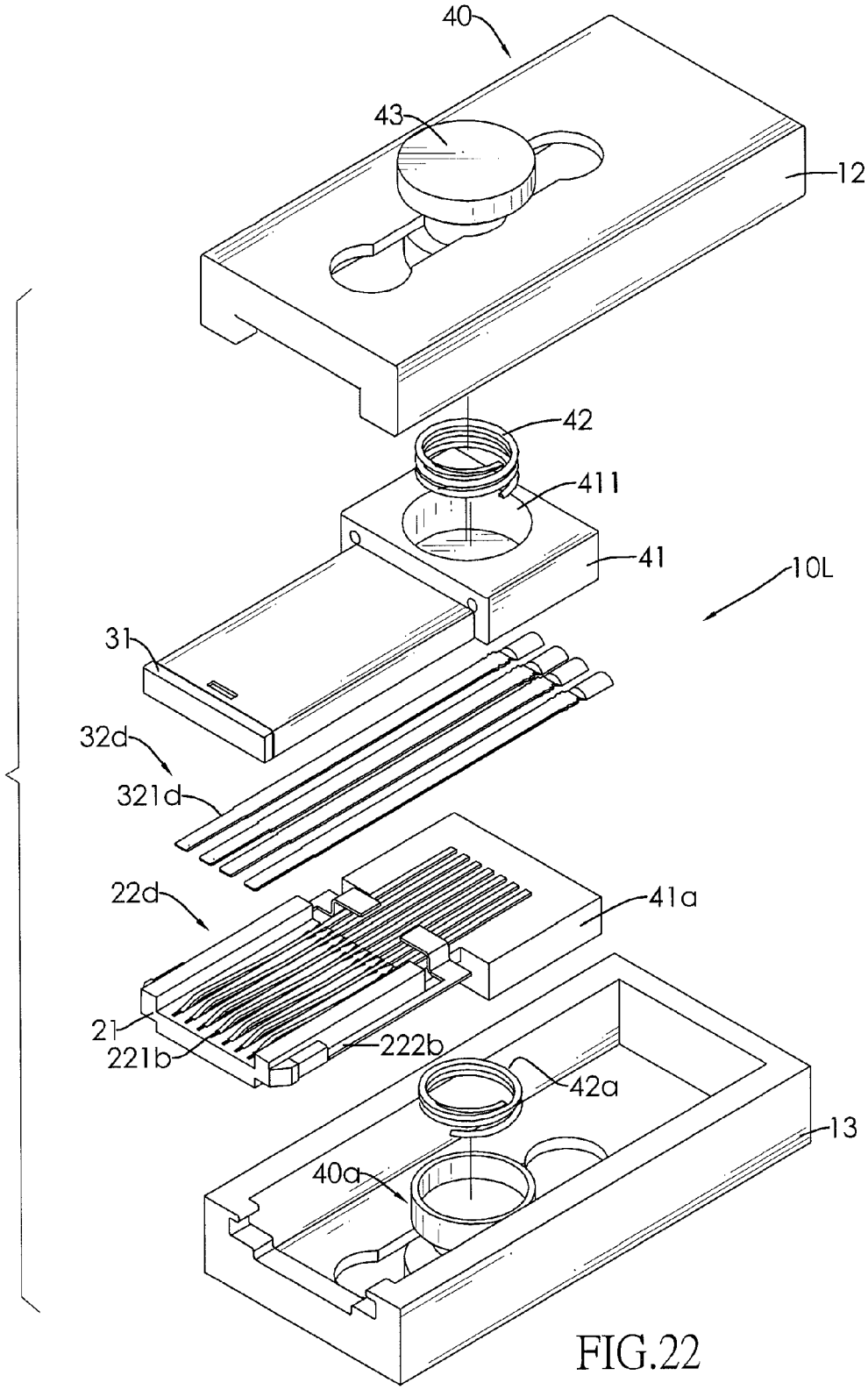
FIG. 22 is a partial exploded perspective view of a thirteenth embodiment of a multi-in-one connector in accordance with the present invention.

With further reference to FIG. 21, in a twelfth embodiment of a multi-in-one connector (10*k*) that is structurally similar to the second embodiment in FIG. 5, the at least one second contact set (32*b*, 32*c*) comprises a USB 2.0 contact set (32*b*) and a USB 3.0 contact set (32*c*), wherein the USB 2.0 contact set (32*b*) has four contacts (321*b*) and the USB 3.0 contact set (32*c*) has nine contacts (321*b*, 321*c*) including the four contacts (321*b*) of the USB 2.0 contact set (32*b*), wherein the four contacts (321*b*) of the USB 2.0 contact set (32*b*) and the other five contacts (321*c*) are staggered. The at least one first contact set (22*a*) includes an eSATA contact set having seven contacts (221). Alternatively, with further reference to FIG. 22, in a thirteenth embodiment of a multi-in-one connector (10L), the at least one second contact set (32*d*) is a USB 2.0 contact set, the at least one first contact set (22*b*) is an electrified eSATA contact set including seven contacts (221*b*) and two power contacts (222*b*).

Figure 23:
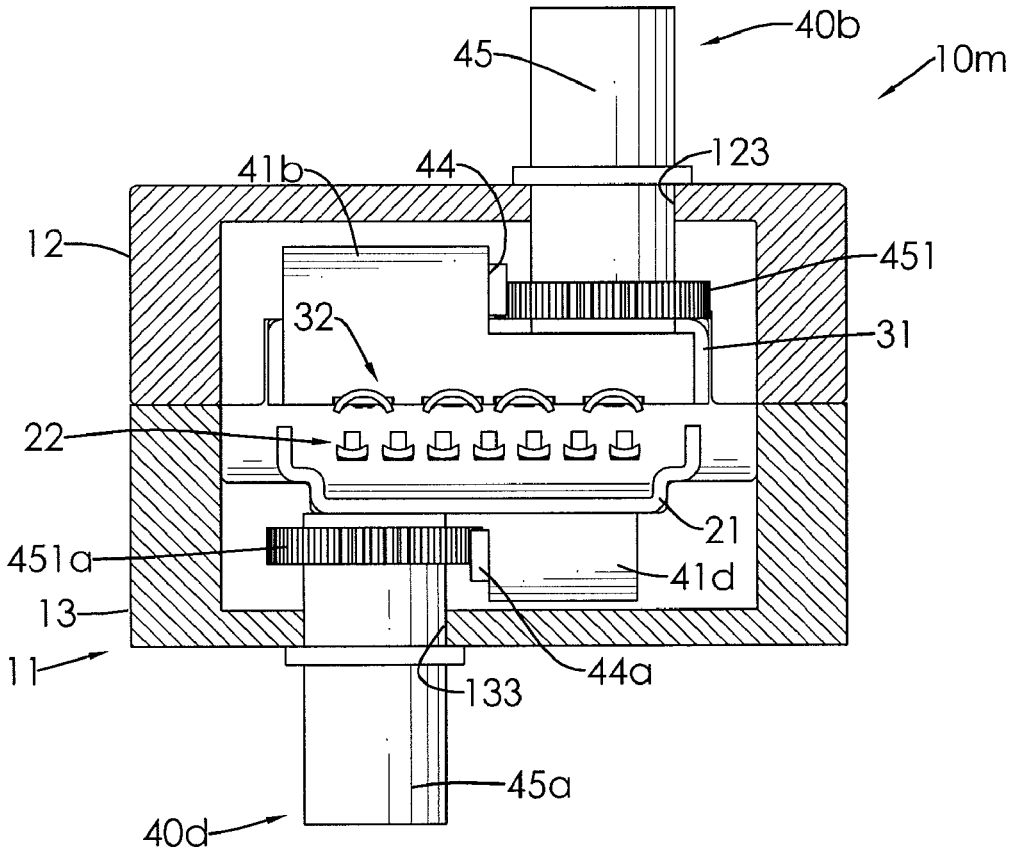
FIG. 23 is a front view in partial section of the fourteenth embodiment of the multi-in-one connector.

With further reference to FIG. 23, in a fourteenth embodiment of a multi-in-one connector (10*m*) that is structurally similar to the third embodiment in FIGS. 6 and 7 however the casing (11) further has a second side opening comprising a second through hole (133) opposite to the through hole (123). The connector (10*m*) further comprises a second release device (40*d*) mounted on the first plug body (21) through the second side opening of the casing (11). The second release device (40*d*) has a second base (41*d*), a second rack (44*a*) and a second turning knob (45*a*). The second base (41*d*) is mounted on the first plug body (21) and beside the second through hole (133). The second rack (44*a*) is mounted on a sidewall of the second base (41*d*) beside the second through hole (133). The second turning knob (45*a*) is mounted through the second through hole (133) and has a second gear portion (451*a*) meshed with the second rack (44*a*).

Figure 24:
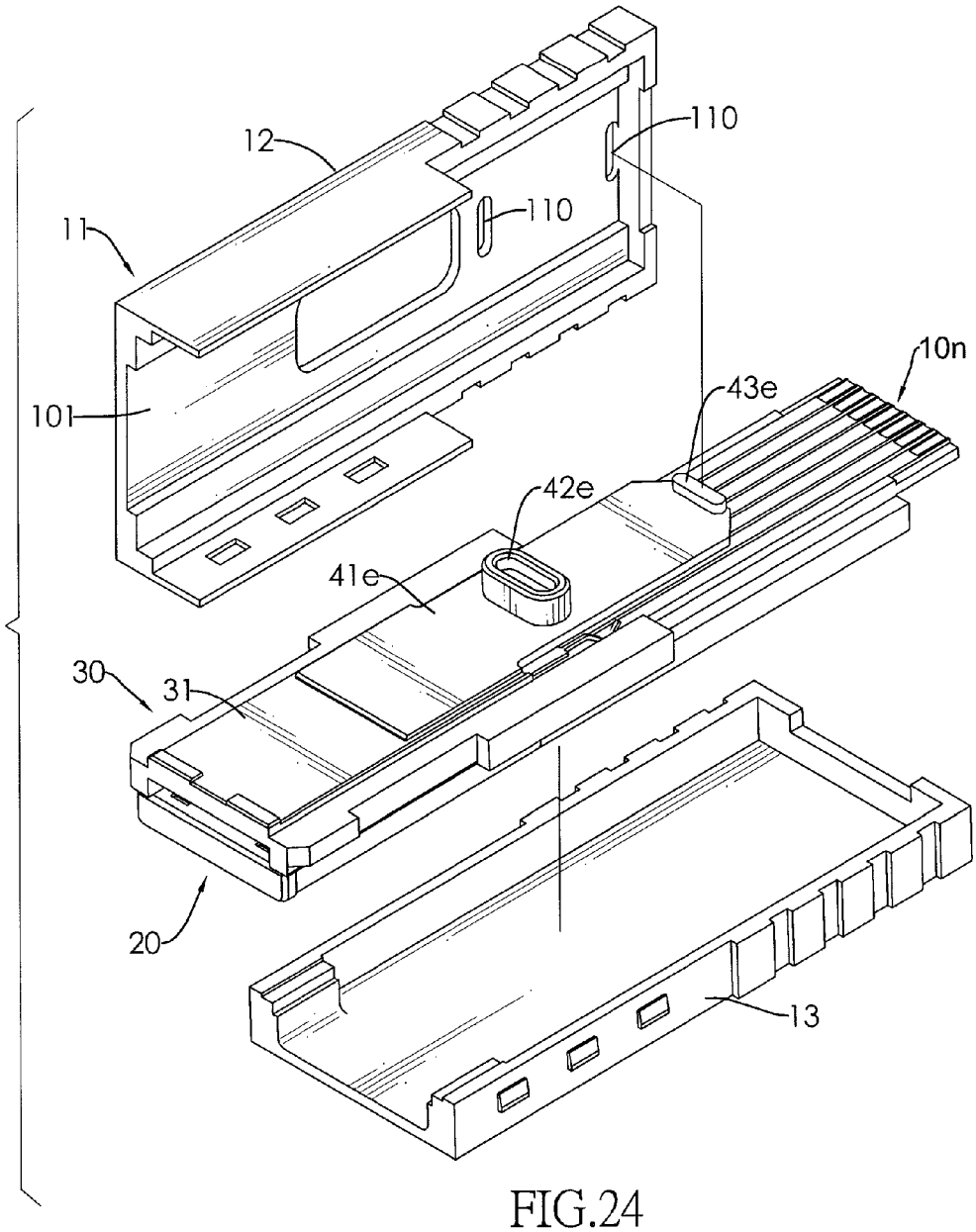
FIG. 24 is a partial exploded perspective view of a fifteenth embodiment of the multi-in-one connector.
Figure 25:
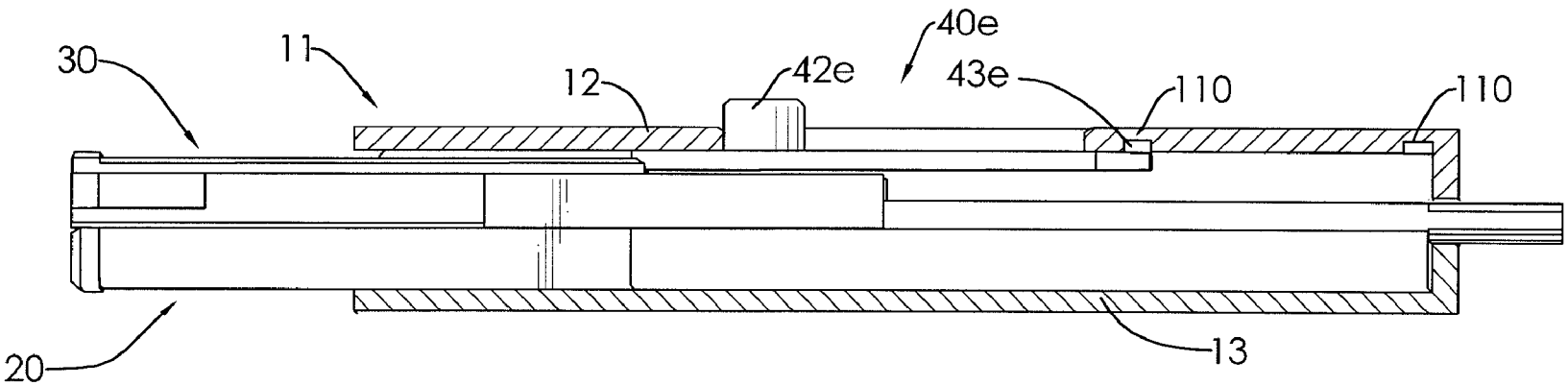
FIG. 25 is a side view in partial section of the multi-in-one connector in FIG. 24.

With further reference to FIGS. 24 and 25, in a fifteenth embodiment of a multi-in-one connector (10*n*) that is structurally similar to the first embodiment, the casing (11) further has two recesses (110) formed on an inner surface of the casing (11) between the side opening and the rear inner wall of the casing (11), wherein one recess (110) is close to the side opening and the other recess (110) is close to the rear inner wall. The release device (40*e*) has a plate (41*e*), a push member (42*e*) and a positioning knob (43*e*). The plate (41*e*) has a front portion mounted on the second plug body (31) and has a free rear portion. The push member (42*e*) is formed on the plate (41*e*) and protrudes through the side opening of the casing (11). The positioning knob (43*e*) is formed on the rear portion of the plate (41*e*) and selectively received in one of the recesses (110) of the casing (11). The push member (42*e*) can be positioned in a rear or front position by engaging the positioning knob (43*e*) with one of the recesses (110). Pressing the push member (42*e*) deforms the plate (41*e*) and disengages the positioning knob (43*e*) from one of the recesses (110). The push member (42*e*) then can be pushed toward the other recess (110) to retract or extend the second plug body (31).

Figure 26:
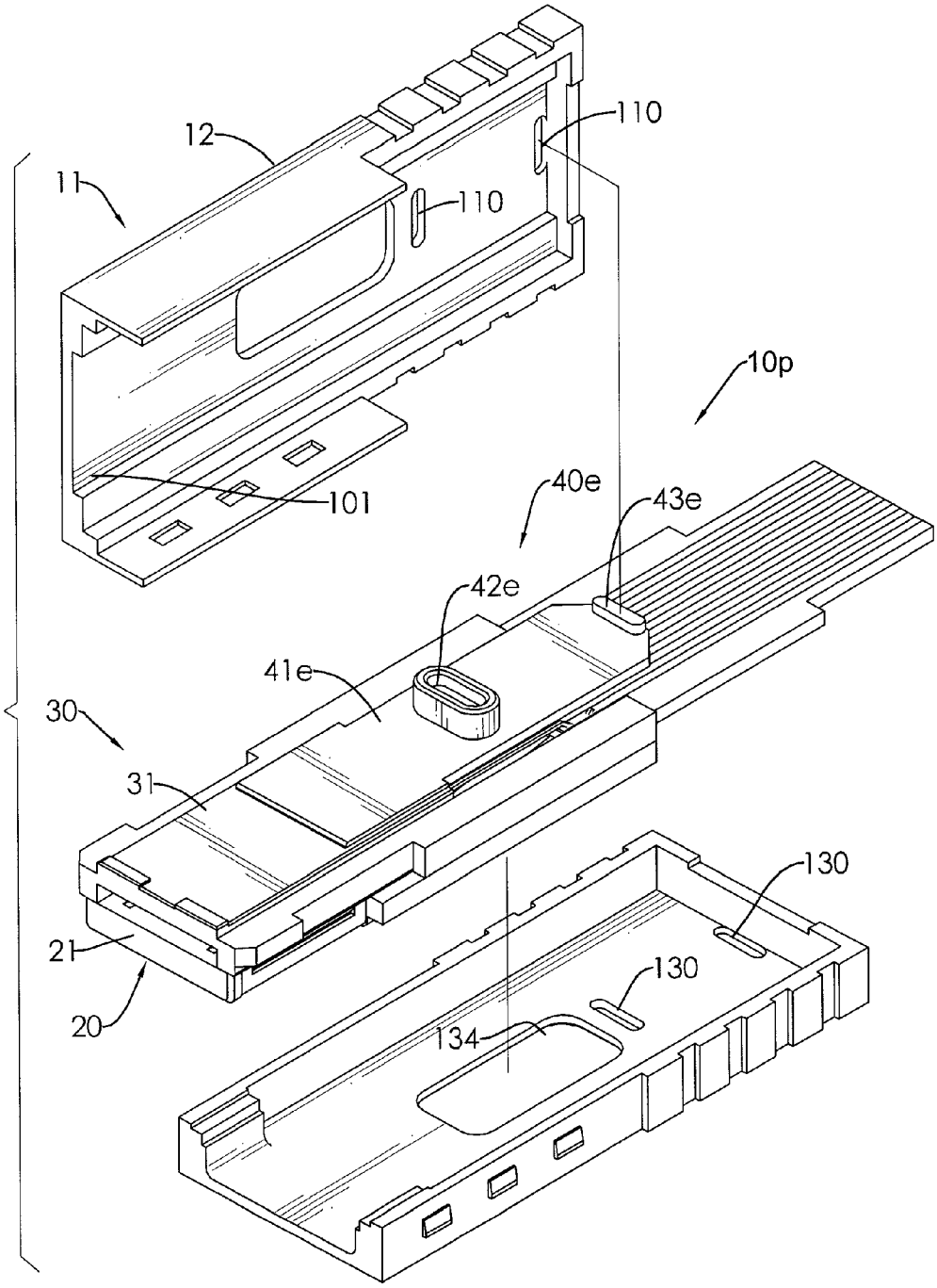
FIG. 26 is a partial exploded perspective view of a sixteenth embodiment of the multi-in-one connector.
Figure 27:
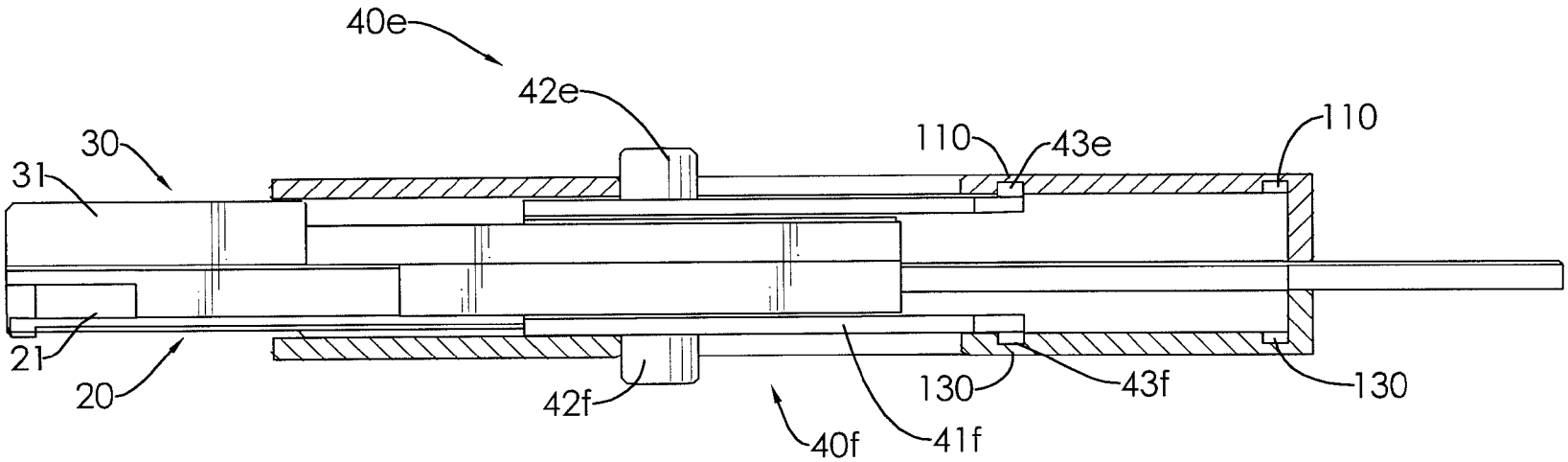
FIG. 27 is a side view in partial section of the multi-in-one connector in FIG. 26.

With further reference to FIGS. 26 and 27, in a sixteenth embodiment of a multi-in-one connector (10*p*) that is structurally similar to the fifteenth embodiment in FIGS. 24 and 25 however the casing (11) further has a second side opening (134) and two second recesses (130). The second side opening (134) is opposite to the side opening. The second recesses (130) are formed between the second side opening (134) and the rear inner wall of the casing (11) and correspond to the recesses (110). The connector (10*p*) further comprises a second release device (40*f*) mounted on the first plug body (21) through the second side opening (134) of the casing (11). The second release device (40*f*) has a second plate (41*f*), a second push member (42*f*) and a second positioning knob (43*f*). The second plate (41*f*) has a front portion mounted on the first plug body (21) and has a free rear portion. The second push member (42*f*) is formed on the rear portion of the second plate (41*f*) and protrudes through the second side opening (134) of the casing (11). The second positioning knob (43*f*) is formed on the rear portion of the plate (41*f*) and selectively received in one of the second recesses (110) of the casing (11).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multi-in-one connector comprising:

a casing having a cavity defined in the casing; and a front opening communicating with the cavity; and a side opening communicating with the cavity;

a plug assembly mounted in the cavity, extending through the front opening and having a first plug; and a second plug slidably mounted in the cavity through the front opening, separately stacked with the first plug, wherein the second plug moves relative to the first plug to extend out of or retract from the front opening; wherein the first plug has a first plug body mounted through the front opening; and at least one first contact set mounted on the first plug body;

the second plug has a second plug body mounted slidably in the cavity through the front opening;

at least one second contact set mounted on the second plug body and facing the at least one first contact set; and at least one extendable second wire set disposed in the cavity and connected to the at least one second contact set; and a release device is mounted on the second plug body of the second plug through the side opening of the casing.

2. The multi-in-one connector as claimed in claim 1, wherein the first plug further has at least one first wire set disposed in the cavity and connected to the at least one first contact set.

3. The multi-in-one connector as claimed in claim 2 further has at least one first spring mounted between the second plug body and a rear inner wall of the casing.

4. The multi-in-one connector as claimed in claim 2, wherein the first plug body is formed on and protrudes from the casing through the front opening.

5. The multi-in-one connector as claimed in claim 4, wherein the side opening comprises multiple separated positioning holes; and a slide slot communicating with the positioning holes and having a width smaller than a diameter of each positioning hole; and the release device has a base mounted on the second plug body, corresponding in position to the slide slot and having a recess;

a second spring mounted in the recess of the base; and a positioning member having a neck portion thinner than the width of the slide slot; and a bottom portion connected to the neck portion, pressing against the second spring and having a diameter corresponding to that of each positioning hole.

6. The multi-in-one connector as claimed in claim 4, wherein the side opening comprises a through hole; and the release device comprises a base mounted on the second plug body and beside the through hole;

a rack mounted on a sidewall of the base beside the through hole; and a turning knob mounted through the through hole of casing and having a gear portion meshed with the rack.

7. The multi-in-one connector as claimed in claim 4, wherein the side opening comprises an elongated hole;

the release device comprises a panel connecting to the second plug and having a longitudinal sidewall facing the elongated hole;

a longitudinal slot formed through the panel adjacent to and parallel to the longitudinal sidewall; and a resilient sheet formed on the longitudinal sidewall and corresponding in position to the longitudinal slot; and a push member mounted on the resilient sheet and protruding from the elongated hole of the casing.

8. The multi-in-one connector as claimed in claim 7, wherein the casing has a wall and further has multiple positioning notches, wherein the elongated hole is formed through the wall and the positioning notches are formed on the wall corresponding in position to the elongated hole; and the panel further has an upper tab formed on and protruding upward from the longitudinal sidewall, corresponding in position to the push member and selectively engaged with one of the positioning notches; and a lower tab formed on and protruding downward from the longitudinal sidewall, corresponding in position to the push member and selectively engaged with a corresponding positioning notch.

9. The multi-in-one connector as claimed in claim 8 further comprises a plugboard disposed between the first plug and the second plug and electrically connected to the at least one first contact set and the at least one extendable second wire set.

10. The multi-in-one connector as claimed in claim 5 further comprises a plugboard, wherein the casing further has a rear opening opposite to the front opening; and the plugboard is mounted in the rear opening, has multiple pins and is electrically connected to the at least one first wire set and the at least one extendable second wire set.

11. The multi-in-one connector as claimed in claim 5 further comprises a plugboard, wherein each of the at least one first wire set has multiple L-shaped pins corresponding in number to contacts of the at least one first contact set and protruding through a bottom surface of the casing; and the plugboard is mounted between the at least one first contact set and a rear inner wall of the casing and having a rear end close to the rear inner wall of the casing and electrically connected to the at least one extendable second wire set;

a front end close to the at least first contact set; and multiple pins mounted on the front end of the plugboard and protruding downward through a bottom surface of the casing.

12. The multi-in-one connector as claimed in claim 11, wherein the first plug body has two opposite side;

the at least one contact set comprises an electrified eSATA contact set having multiple contacts; and two power contacts respectively mounted on the side of the first plug body and electrically connected to the plugboard via a wire; and the plugboard further has two power pins protruding downward through a bottom surface of the casing.

13. The multi-in-one connector as claimed in claim 12, wherein the at least one second contact set comprises a USB 2.0 contact set and a USB 3.0 contact set.

14. The multi-in-one connector as claimed in claim 6 further comprises a plugboard, wherein the casing further has a rear opening opposite to the front opening; and the plugboard is mounted in the rear opening and has multiple pins electrically connected to the at least one wire set and the at least one extendable second wire set.

15. The multi-in-one connector as claimed in claim 3, wherein the first plug body has an eSATA plug outline; and the second plug body has a USB plug outline.

16. The multi-in-one connector as claimed in claim 3, wherein the first plug body has a USB plug outline; and the second plug body has an eSATA plug outline.

17. The multi-in-one connector as claimed in claim 1, wherein the casing further has two recesses formed on an inner surface of the casing between the side opening and a rear inner wall of the casing;

one recess of the casing is close to the side opening and the other recess of the casing is close to the rear inner wall of the casing; and the release device has a plate having a front end mounted on the second plug body; and a free rear end;

a push member formed on the plate and protruding through the side opening of the casing; and a positioning knob formed on the rear end of the plate and selectively received in one of the recesses of the casing.

* * * * *